US005120064A

United States Patent [19]

Cerami

[11] Patent Number: 5,120,064

[45] Date of Patent: Jun. 9, 1992

[54] GOLFERS' SWING TRACING TRAINING AID

[76] Inventor: Richard M. Cerami, 5429 Exeter Rd., Erie, Pa. 16509

[21] Appl. No.: 782,134

[22] Filed: Oct. 25, 1991

[51] Int. Cl.[5] ..... A63B 69/36

[52] U.S. Cl. ..... 273/186 C; 273/194 R; 273/200 B

[58] Field of Search ..... 273/186 D, 187 R, 186 AA, 273/191 R, 192, 183 D, 186 A, 186 C

[56] References Cited

U.S. PATENT DOCUMENTS

| | | | |
|---|---|---|---|
| 2,995,376 | 8/1961 | Leo | 273/186 D |
| 3,300,219 | 1/1967 | Sipos | 273/187 R |
| 3,311,377 | 3/1967 | Holbus | 273/186 D |
| 3,687,459 | 8/1972 | Swords | 273/186 D |
| 4,456,257 | 6/1984 | Perkins | 273/186 AA X |

*Primary Examiner*—George J. Marlo
*Attorney, Agent, or Firm*—Lovercheck and Lovercheck

[57] ABSTRACT

A golf swing training device made up of a markable sheet, a club with a head and a handle, a marker supported on the club adjacent the central axis of the club and a spring. The spring urges the marker toward the sheet along a path parallel to the central axis of the club when the club is swung causing the marker to move in a line parallel to the axis of the club handle to trace lines on the sheet. These trace lines shows the path of the club head during the repeated golf swings. The positions of the trace lines can be compared, thereby providing comparisons showing the corrections needed in the golfer's swing.

9 Claims, 2 Drawing Sheets

GOLFERS' SWING TRACING TRAINING AID

BACKGROUND OF THE INVENTION

This invention relates to golf practice devices, and more particularly to a golf swing recording attachment which can be mounted on the head of a golf club and will indicate the nature of a defect or show the variation of the paths in the user's swing, such as a slice or a hook.

Applicant is aware of U.S. Pat. No. 3,687,459 to Swords which shows a golf swing teaching aid. The golf club has a pair of scribers rigidly attached to the head thereof. The scribers can be adjusted relative to one another and in relation to the head of the golf club, but these scribers have no means of automatically adjusting for variation in the radius of the swing of the golfer to present damage to the scriber, sheet surface or both.

U.S. Pat. No. 3,311,377 to Holbus shows a golf swing practicing device which uses a golf club with a marker rigidly held in a holder and connected to the club which would be damaged if the radius of the arc of the golfer's swing was increased over a predetermined amount of time.

SUMMARY OF THE INVENTION

Applicant has provided an improved golf teaching device that utilizes a golf club with an axial bore in the shaft. The bore extends to the lower edge of the club head and has a threaded counterbore that receives a bored threaded plug. The bored threaded plug receives a spring loaded cartridge which will be forced to retract when the marker touches a marking surface during an intermediate part of a golfer's stroke. Thus, during a swing, when the golf club passes close to a marking surface the marker element will engage the surface and mark the path of the golf club over the marking surface and will be forced up into the club against the spring thereby protecting the marker element.

The invention includes a mat of soft material, which may be a foam plastic, approximately 18" long by 15" wide by 3/16" thick. The mat material must be sufficiently soft so that it will be indented by the marker and yet not be damaged by the marker. The mat is covered by a cover sheet of a markable, erasable plastic material of a type available in office supply stores that can be marked on with an erasable type marker. The mat and the erasable cover sheet each have a hole in their center so that a simulated golf ball can be put in the hole. The simulated ball may be a rubber hose about a half-inch in diameter and two inches long which will deflect out of the way when struck by the golf club. The golfer takes his stance at a comfortable distance from the center of the mat, rests his golf club head on the erasable cover sheet and positions his feet. The golf clubs head will have a mark to align with the golf ball. The golfer then marks the location of the toes of his shoes to enable him to repeat the position of his stance. The golfer then repeatedly swings at the simulated ball and studies the relative positions of the marker tracer. The traces would ideally be very close together.

The golf club according to the invention is simple and may be like any other golf club, but has a marking element thereon which could be a part of the club. The golfer marks the position of his/her feet, positions a mark on the club head in line with a mark on the erasable cover sheet adjacent a mark on the simulated ball. If the golfer has developed a correct swing, the marker element should closely follow the same mark on the sheet with consecutive swings. Thus, the golfer will have a good indication of how consistent his swing is.

The system of the invention is easy to maintain. By removing a threaded plug from the bottom of the golf club, a new marker element can be inserted. The erasable cover sheet is easily cleaned with a damp cloth.

The clip-on units are convenient to use and have only clips to remove in order to change the cartridge. The clip-on unit can be connected to any golf club so a golfer can practice with the club he/she has the most problem with. The unit can be used by either a right-handed or left-handed golfer. In one embodiment, the cartridges are attached to the club with clips and thumb screws. The use of the clip-on unit shown in FIG. 4, is basically the same as the club unit shown in FIGS. 1, 2 and 3.

The apparatus of the present invention can be used in any area that has sufficient space to fully swing a golf club (garage, driveway or yard), and can be used with a simulated or real golf ball at a golf range, field or any area that has sufficient space.

In use of the apparatus according to the invention, (a) the club will rest in a normal position on the erasable cover sheet giving the golfer a comfortable feel; (b) a spring in the golf club cartridge will be weak enough to support the marker element with only the weight of the club; but, strong enough to eject the marker element to keep it in contract with the erasable cover sheet. On the back swing, the marker element protrudes approximately ¾" from the golf club head; on the forward swing, the marker may be almost flush with the club bottom; and, (d) the marker element will mark the erasable cover sheet during both the back and forward swing of the golfer.

It is an object of the invention is to provide a novel and improved golf swing testing attachment which is simple in construction, can be easily attached to the head of a golf club for testing the user's swing, and provides an accurate indication of the nature of a defect in the user's swing so that he may readily correct such a defect.

Another object of the invention is to provide an improved golf swing testing attachment for a golf club. The attachment involves very inexpensive components, is durable in construction, is easy to attach to the head of a golf club and easy to remove therefrom.

Another object of the invention is to provide a reliable indication as to a defect in the user's swing, such as a slice or a hook, whereby the user may readily correct such a defect and wherein the success of such correction can be readily observed by the user of the testing attachment.

Another object of the invention is to provide an improved golf club.

Another object of the invention is to provide a golf club attachment that is simple in construction, economical to manufacture and simple and efficient to use.

Another object of the invention is to provide a golf club that can be used with or without the marker element, as a training device.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENTS

Figure 1:
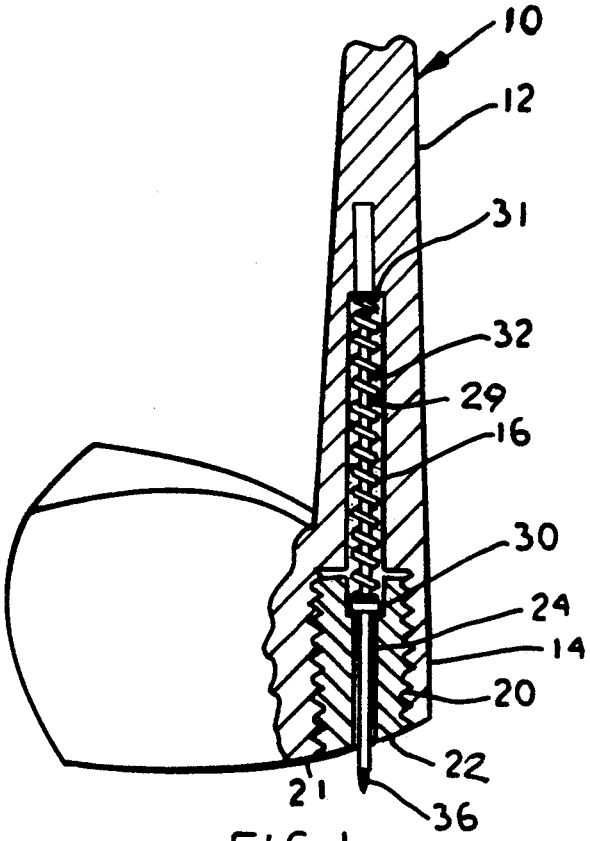
FIG. 1 is a partial longitudinal cross sectional view of a golf club according to the invention.
Figure 2:
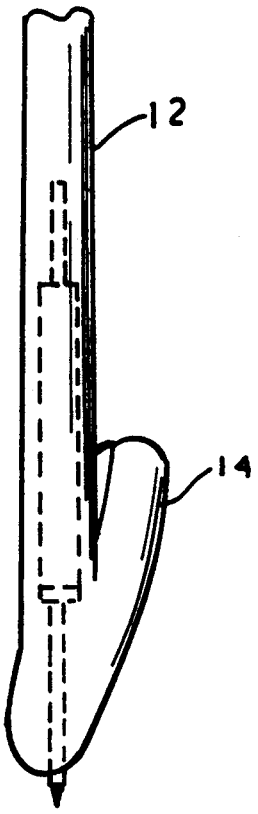
FIG. 2 is a rear view of the golf club according to the invention.
Figure 5:
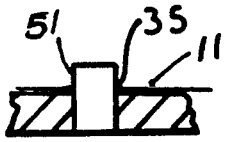
FIG. 5 is a partial cross sectional view of a simulated golf ball and a support pad according to the invention.

Now with more particular reference to the drawings, shown in the embodiment of FIGS. 1, 2, 3 and 5, golf club 10 has a shaft or handle 12, head 14 and bottom side 21. First bore 16 extends through head 14 and up into handle 12. Threaded counterbore 20 extends to bottom side 21 of golf club 10. Closure 22 having second bore 24 therethrough, is threadably received in threaded counterbore 20. Closure 22 is counterbored at an inner end to receive stop member 30 which is attached to elongated rod 29 of closure 22 engaging one end of first bore 16. Spring 32 is in the form of a helical spring and is supported on elongated rod 29, rests against stop member 30 at one end, and against bottom 31 of first bore 16 at the other end, which urges stop member 30 to a position shown in FIG. 1. Marker tip 36 may be a felt tip marker of the type familiar to those skilled in the art and generally referred to as a "Magic Marker" that will provide an erasable mark on erasable cover sheet 40 supported on mat 11. The center of mat 11 has hole 35 therein to receive the lower part of simulated golf ball 51.

In use, a golfer will take his stance near mat 11 with the toes of his shoes located in comfortable positions 38. Positions 38 of the toes of his shoes may be marked with golf tees, or other suitable devices so that he can repeat the same stance at a later time. The golfer will then rest golf club 10 on erasable cover sheet 40 adjacent simulated golf ball 51. A mark can be made on end 50 of head 14 to enable the golfer to place golf club 10 adjacent a similar mark on mat 11 adjacent simulated golf ball 51. The golfer can then repeatedly swing golf club 10 at simulated golf ball 51 and on each swing, marker tip 36 will record trace lines 45 on erasable cover sheet 40. After the golfer has completed several swings, trace lines 45 can be compared and the uniformity of his swings can be appraised and the marks can be erased.

Figure 3:
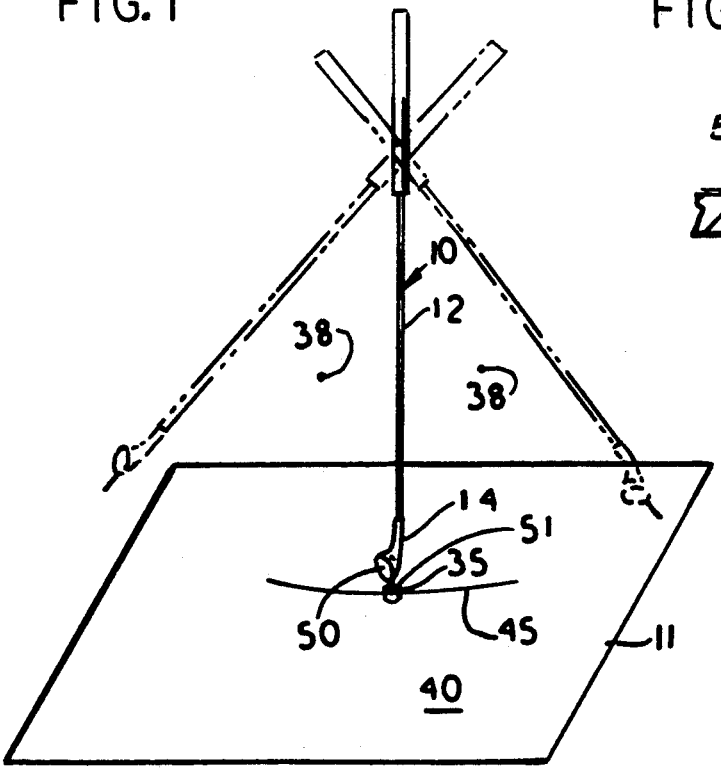
FIG. 3 is an isometric view of one embodiment of a golf swing practice device according to the invention using a dedicated club.
Figure 4:
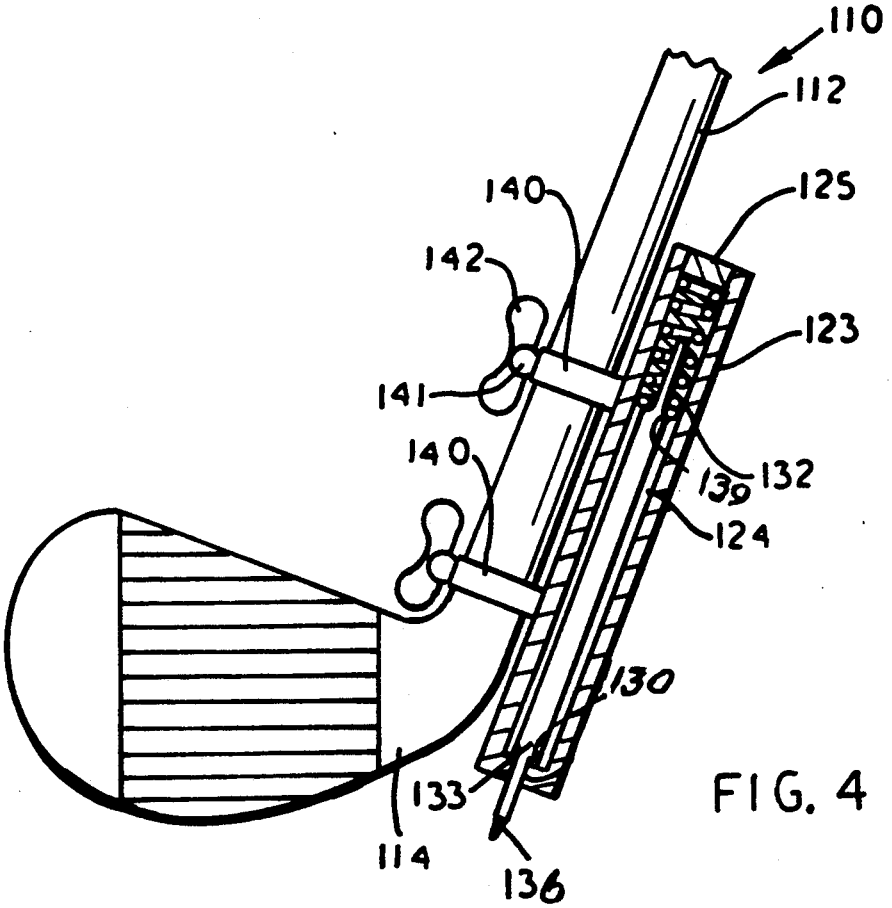
FIG. 4 is a side view of another embodiment of the golf club according to the invention.

Now with more particular reference to the embodiment of FIGS. 3 and 4, golf club 110 is a conventional club having handle 112 and head 114. Cartridge 123 is held to handle 112 by means of clips 140 which are held in place by threaded bolts 141 having wing nuts 142. Cartridge 123, has second bore 124 with upper closed end 125, which receives marker holder 133. Marker holder 133 has first shoulder 130 which forms a stop. Marker holder 133 receives spring 132 which rests on upper closed end 125. Spring 132 engages upper closed end 125 and second shoulder 139 which urges marker holder 133 toward the position shown in FIG. 4. Marker tip 136 may be a felt tip containing an erasable material that will provide an erasable mark on erasable cover sheet 40.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a golf club having a shaft;
said shaft having a longitudinal axis;
said golf club further having a head and an elongated marking device;
said head being fixed to said shaft;
a supporting means supporting said marking device on said shaft;
resilient means having an elongated axis located either generally parallel to the longitudinal axis of said shaft or in alignment with said axis urging said marking device in a direction generally parallel to or along said longitudinal axis of said shaft and away from said shaft and said head and adapted to be urged toward a sheet of material while marking traces of the path of said club head on said sheet of material during successive swings of said club by a golfer; and,
said marking traces being adapted to be compared with one another to analyze said swings of said golf club.

2. The combination recited in claim 1 wherein said resilient means is in the form of a helical spring;
said marking device has a marker tip; and,
said resilient means is adapted to urge said marker tip toward said sheet of material when said golf club is swung over said supporting means.

3. The combination recited in claim 1 wherein said supporting means comprises a clamping means whereby said marking device is removably clamped to said golf club with said marking device closely adjacent to said longitudinal axis of said shaft.

4. The combination recited in claim 3 wherein said supporting means has an upper closed end; and,
said marking device having clips and threaded bolts to clamp said marking device to said golf club.

5. The combination recited in claim 1 wherein said supporting means comprises a hollow cylindrical cartridge having a hollow cylindrical bore therein;
said resilient means and said marking device are slidably received in said hollow cartridge;
clamping means clamping said hollow cartridge to said golf club shaft adjacent said longitudinal axis of said shaft;
said resilient means being adapted to urge said marking device along a path adjacent to said axis of said shaft into engagement with said sheet of material.

6. The combination recited in claim 1 wherein said supporting means comprises a tubular cartridge having said elongated marking device therein;
said cartridge being supported on said shaft with a bore therein;
said cartridge being disposed generally parallel to and adjacent said longitudinal axis of said shaft, and said elongated marking device being disposed in said bore.

7. In combination, a golf club and a marking device;

support means supporting said marking device on said golf club and an erasable cover sheet of markable material;

said golf club has a shaft;

said erasable cover sheet being made of said markable material and disposed over a relatively soft mat and adapted to receive trace lines from said marking device thereon;

a first bore in said golf club shaft;

said first bore having a first end and a second end;

said first bore terminating at said first end in a bottom;

said first bore being generally in alignment with the axis of said shaft;

said marking device being received in said first bore;

a closure at said second end of said first bore;

said closure defining a stop member; a reduced size second bore in said closure and a reduced size part of said marking device extending through said reduced size second bore;

resilient means in said first bore engaging said bottom urging said marking device toward said second end of said bore whereby said marking device is urged toward said sheet during a swing of said golf club.

8. The combination recited in claim 7 wherein said marker device is a felt-tip like marker.

9. The combination recited in claim 7 wherein said sheet is a display type plastic sheet and said marker device is an erasable marker.

* * * * *